US005476532A

United States Patent [19]

Steeghs

[11] Patent Number: 5,476,532

[45] **Date of Patent: * Dec. 19, 1995**

[54] METHOD FOR PRODUCING REDUCIBLE IRON-CONTAINING MATERIAL HAVING LESS CLUSTERING DURING DIRECT REDUCTION AND PRODUCTS THEREOF

[75] Inventor: Harry R. G. Steeghs, Englewood, Colo.

[73] Assignee: Akzo Nobel N.V., Arnhem, Netherlands

[ * ] Notice: The portion of the term of this patent subsequent to Dec. 13, 2011, has been disclaimed.

[21] Appl. No.: 277,844

[22] Filed: Jul. 20, 1994

Related U.S. Application Data

[63] Continuation-in-part of Ser. No. 119,775, Sep. 10, 1993, Pat. No. 5,372,628.

[51] Int. Cl.[6] ..... C22B 1/24

[52] U.S. Cl. ..... 75/300; 75/322; 75/447; 75/773

[58] Field of Search ..... 75/300, 443, 447, 75/322, 773

[56] References Cited

U.S. PATENT DOCUMENTS

| | | | |
|---|---|---|---|
| 3,062,639 | 1/1962 | Sterling | 75/26 |
| 3,341,322 | 9/1967 | Bailey . | |
| 3,549,352 | 12/1970 | Mayer . | |
| 3,615,352 | 10/1971 | Mayer . | |
| 3,975,182 | 8/1976 | Goetzman | 75/322 |
| 4,042,375 | 8/1977 | Martin et al. | 75/4 |
| 4,288,245 | 9/1981 | Roorda et al. | 75/0.5 R |
| 4,695,315 | 9/1987 | Kortmann et al. | 75/0.5 R |
| 5,000,783 | 3/1991 | Dingeman et al. | 75/321 |
| 5,372,628 | 12/1994 | Steeghs | 75/443 |

FOREIGN PATENT DOCUMENTS

| | | |
|---|---|---|
| 1193440 | 9/1985 | Canada . |
| 207779 | 1/1987 | European Pat. Off. . |
| 0225171 | 6/1987 | European Pat. Off. . |
| 0541181 | 5/1993 | European Pat. Off. . |
| 2061346 | 6/1972 | Germany . |

*Primary Examiner*—Melvyn Andrews
*Attorney, Agent, or Firm*—Ralph J. Mancini; Joseph M. Noto; Louis A. Morris

[57] ABSTRACT

A method for abating the incidence of cluster formation of reducible iron-containing material during the direct reduction of said material is disclosed. The method generally comprises contacting the reducible iron-containing material with a cluster-abating effective amount of either a dispersion which comprises at least one particulate material which is substantially nonhardening in the presence of water and at least one fluxing agent or a dispersion which comprises an aluminum-containing clay.

25 Claims, No Drawings

METHOD FOR PRODUCING REDUCIBLE IRON-CONTAINING MATERIAL HAVING LESS CLUSTERING DURING DIRECT REDUCTION AND PRODUCTS THEREOF

The present application is a Continuation-In-Part of application Ser. No. 08/119,775 filed on Sep. 10, 1993, now U.S. Pat. No. 5,372,628.

BACKGROUND OF THE INVENTION

The present invention relates to a novel process for lowering the incidence of clustering or sticking of reducible iron-containing material during the direct reduction of said material. The process comprises contacting the reducible iron-containing material with a dispersion which comprises at least one non-pozzolanic particulate material and at least one fluxing agent. Said contacting occurs at a point prior to the introduction of said reducible iron-containing material into the direct reduction furnaces. In another embodiment, the process comprises contacting the reducible iron-containing material with a dispersion which comprises an aluminum-containing clay.

It is a well known technical problem that particulate reducible iron-containing material tends to stick together, forming large clusters or agglomerates during their processing in a direct reduction furnace. These clusters tend to remain intact during treatment in a direct reduction furnace, impeding appropriate flow through the furnace. One possible though unacceptable solution to this problem is lowering the furnace temperature and through put. From the perspective of efficiency alone this solution is not appropriate.

Other solutions have been suggested to decrease clustering in a direct reduction furnace while maintaining a high processing rate through the furnace. For example, European Patent Specification No. 207 779 teaches application of a cement coating to the surface of burned iron ore prior to direct reduction in order to prevent agglomeration in the direct reduction furnace. U.S. Pat. No. 3,062,639 discloses a process for treating reducible iron oxide by contacting the iron oxide with a solution comprising an element selected from the group consisting of an alkali metal, an alkaline earth metal, a metal of group V, a metal of group VIB, boron, and silicon. This is intended to prevent clustering in the furnace reduction zone.

U.S. Pat. No. 13,549,352 discloses a process for substantially suppressing bogging (clustering) in an iron ore reduction process by adding directly to a ferrous reduction bed a dry powder selected from alkaline earth metal oxides or carbonates, especially the oxides of calcium and magnesium.

In U.S. Pat. No. 3,975,182, a method to produce iron oxide pellets which do not form clusters in a vertical shaft moving bed is disclosed. In that method, a surface coating of lime, limestone or dolomite is formed on iron oxide pellets. The lime-containing material is added in dry form in a balling machine with a spray of a little water to promote adhesion. The pellets are then fired to form a hard coating.

DE-OS-2 061 346 discloses a process for reduction of iron ore pellets which consists of coating said pellets with a ceramic powder prior to introduction into the direct reduction furnace. A special adhesive may be sprayed on the pellets in order to promote the adhesion of the ceramic powder to the pellets.

However, such above mentioned solutions are not adequate to overcome ore clustering in direct reduction furnaces at the processing rates and conditions currently required.

Accordingly, the development disclosed herein surprisingly lowers the occurrence of clustering of reducible iron-containing material and improves material flow in direct reduction furnaces.

SUMMARY OF THE INVENTION

The present invention is directed to a method for lowering the incidence of clustering of reducible iron-containing material during the direct reduction of said material. The method comprises contacting the reducible iron-containing material prior to the direct reduction thereof with a cluster-abating effective amount of a dispersion which comprises at least one fluxing agent and at least one particulate material which is substantially nonhardening in the presence of water, wherein said contacting occurs prior to the direct reduction of said reducible materials.

In another embodiment, the instant invention involves contacting a reducible iron-containing material prior to the direct reduction thereof with a cluster-abating effective amount of a dispersion which comprises at least one aluminum containing clay.

The current invention is also directed to the reducible iron-containing materials which have been treated by the methods of this invention.

DETAILED DESCRIPTION OF THE INVENTION

The present invention generally relates to a method for lowering the incidence of clustering of reducible iron-containing material during direct reduction of such material. The method comprises contacting the reducible iron-containing material with a cluster-abating effective amount of a dispersion of at least one particulate material, said particulate material being substantially nonhardening in the presence of water, and said contacting occurring prior to direct reduction. In another embodiment, the method comprises contacting the reducible iron-containing material with a cluster-abating effective amount of a dispersion which comprises at least one fluxing agent and at least one particulate material prior to direct reduction. In yet another embodiment, the process comprises contacting the reducible iron-containing material with a dispersion which comprises an aluminum-containing clay. The present method allows one to prepare reducible iron-containing materials which exhibit low clusterability during high temperature reduction which results in more efficient and/or effective operation of the direct reduction furnace by allowing, for example, higher operation temperatures, increased through put, etc.

The reducible iron-containing material of the instant invention may be in any form that is typical for processing through a direct reduction furnace. For nonlimiting example, the reducible iron-containing material may be agglomerated (e.g. pelletized, briquetted, granulated, sintered, etc.) and/or in natural virgin form (e.g. lump ore, fine ore, concentrated ore, etc.)

In one embodiment, the reducible iron-containing material is in the form of pellets comprising binder and/or other typical additives employed in iron ore pellet formation. For nonlimiting example, such binders may be a clay, such as bentonite, montmorillionite, etc.; a water-soluble natural polymer, such as guar gum, starch, etc.; a modified natural polymer, such as guar derivatives (e.g. hydroxypropyl guar, carboxymethyl guar), modified starch (e.g., anionic starch, cationic starch), starch derivatives (e.g., dextrin) and cellulose derivatives (e.g., hydroxyethyl cellulose, carboxymethyl cellulose, hydroxypropyl cellulose, methyl cellulose, etc.); and/or a synthetic: polymer (e.g., polyacrylamides, polyacrylates, polyacrylamidepolyacrylate copolymers, polyethylene oxides, etc. ). Such binders my be used alone or in combination with each other, and with or without inorganic compounds including but not limited to activators such as alkali carbonates, phosphates, citrates, etc.

The binder may also be supplied in the form of a binder composition. A binder composition is often comprised of a binder or modified binder containing by-products of the binder formation as well as desired additives.

A particularly preferred binder or binder composition of the instant invention is comprised of an alkali metal salt of carboxymethyl cellulose (CMC). The binder or binder composition of an alkali metal salt of CMC may contain as by-products, for example, sodium chloride and sodium glycolate, as well as other polysaccharides or synthetic water-soluble polymers and other "inorganic salts" (for nonlimiting example sodium carbonate, sodium citrate, sodium bicarbonate, sodium phosphate and the like).

A series of commercially available binders containing sodium carboxymethyl cellulose especially useful in the present invention is marketed by Dreeland, Inc. of Denver, Colo., USA and Akzo Chemicals of Amersfoort, the Netherlands, under the trademark Peridur.

As typical composition additives may be mentioned, by nonlimiting example, flux (e.g., limestone, dolomite etc.), minerals to improve metallurgical properties of the pellets (e.g. olivine, serpentine, magnesium, etc.), caustic and coke.

Typical binders and additives, as well as the method of use of binders and additives are well known in the relevant art and thus need no detailed explanation here. See, for nonlimiting example, U.S. Pat. Nos. 5,000,783 and 4,288,245.

As used herein, "dispersion" means any distribution or mixture of fine, finely divided and/or powdered solid material, or mixture of such materials, in a liquid medium. The similar terms "slurry" "suspension" etc are also included in the term "dispersion".

The dispersions of the present invention may optionally employ a stabilizing system which assists in maintaining a stable dispersion and enhance adhesion of the particulate material to the reducible iron-containing material, e.g., agglomerates. Any conventionally known stabilizing system can be employed in this regard with the proviso that they assist in stabilizing the dispersion. Examples of such stabilizing systems include but are not limited to systems which employ dispersants, stabilizers or combinations thereof. Preferred dispersants include but are not limited to organic dispersants including but not limited to polyacrylates, polyacrylate derivatives and the like and inorganic dispersants including but not limited to caustic, soda ash, phosphates and the like. Preferred stabilizers include both organic and inorganic stabilizers including but not limited to xanthan gums or derivatives thereof, cellulose derivatives such as hydroxyethyl cellulose, carboxymethylcellulose, carboxymethylhydroxyethyl cellulose, ethylhydroxyethylcellulose and the like, guar, guar derivatives, starch, modified starch, starch derivatives and synthetic viscosifiers such as polyacrylamides, polyacrylamide/polyacrylate copolymers, mixtures thereof and the like, mixed metal hydrates, synthetic hectorites, highly purified sodium montmorillonites, etc.

As used herein, a "particulate material being substantially nonhardening in the presence of water" is a divided, finely divided and/or powdered material capable of forming a dispersion in a liquid medium and is substantially inert to hardening when mixed with water, unlike, for nonlimiting example, portland cement. In a preferred embodiment, the particulate material comprises aluminum and/or is an aluminum source. More preferably, the particulate material is a bauxite and/or an aluminum-containing clay. Examples of aluminum-containing clays which are employable in the context of the present invention include but are not limited to bentonite, the kaolin minerals such as kaolinites, dickites, nacrites, halloysites and the like, serpentine clays such as lizardite, antigorite, carlosturanite, anestite, cronstedite, chamosite, berthierine, garnierite and the like, nodular clays, burleyflint clay, burley and diaspore, zeolites, pyrophyllites, smectite minerals such as montmorillorites, beidellites, nontronites, hectorites, soponites, sauconites volkhonskoites, medmontites, pimelites and the like, illites, glauconites, celadonites, chlorites such as clinochlores, chamosites, nimites, bailychlores, donbassites, cookites, fosterites, sudoites, franklinfurnacecites, and the like, vermiculites, palygorskites (attapulgites), sepiolites, mixed layer mineral clays, amorphous and miscellaneous clays such as allophanes and imogolites, and high alumina clays such as diaspore clays, boehmite clays, gibbsite clays, cliachites, bauxite, bauxitic clays and gibbsitic or bauxitic kaolins. Alternatively, synthetic sodium aluminum silicates can be beneficially utilized. The particulate materials can be employed in either the hydrated or unhydrated forms.

The size of the particulate material in the dispersions of the current invention is determined by the type of particulate material and its ability to form a dispersion in the medium selected. Thus, it may be said that, in general, the average size of the particulate material will be in the range of, for nonlimiting example, below about 1 millimeter; typically in the range of between about 0.01 microns to about 500 microns. More preferably, the average size of particulate is in the range of between 0.05 and 100 microns. However, as explained above, the size of the particulate material will vary depending on many factors, but is well known to a person skilled in the art.

Any fluxing agents conventionally employed in iron and steelmaking can be utilized in the dispersion of the present invention. Preferably, lime-bearing materials are employed as fluxing agents. Non-limiting examples include lime, calcium and/or magnesium bearing materials, dolomite, olivine, fosterite, limestone and the like.

The dispersion of the present invention may also contain various materials and/or additives which are conventionally employed to improve the metallurgical properties of the pellets. Non-limiting examples include olivine, serpentine, magnesium, caustic, coke and the like. Again, the particle size of this material should be in the same range as that of the particulate materials.

In carrying out the method of the instant invention, various techniques may be used to contact the reducible iron-containing material with the dispersion of particulate material or particulate material and fluxing agent. The methods preferably employed involve forming a dispersion (slurry, suspension etc.) of the particulate material(s) and fluxing agent(s). Such dispersions, mixtures, suspensions and/or slurries are formed with the aid of a liquid medium, for nonlimiting example, water, organic solvents, solutions/dispersions of water-soluble/water-dispersible polymer(s) in water (e.g. to enhance dispersion), etc. The reducible iron-containing material (preferably, but not necessarily already in the form of pellets) is then contacted with the resulting dispersion, mixture, suspension and/or slurry. Such contacting may take place by, for example, spraying and/or dipping, and further, it may be partial or complete. For example, if such contacting is accomplished by dipping, the reducible iron-containing material may be partially dipped or completely immersed.

In any event, the reducible iron-containing material may be contacted with said dispersions described herein at any time prior to direct reduction. For example, if the reducible iron-containing material is provided in the form of pellets, the dispersion may be applied to either green or fired pellets.

The "cluster-abating effective amount" will vary depending upon numerous factors known to the skilled artisan. Such factors include, but are not limited to, the type of reducible iron-containing material, as well as its physical form, moisture content, etc., the specific particulate material(s) and fluxing agent(s) employed, as well as their form and other physical characteristics, the dispersion medium (e.g. water, alcohol, etc.), the concentration of particulate material(s) and fluxing agent(s) in the dispersion medium, the operating conditions of the direct reduction furnace, etc.

Though not limiting, a cluster-abating effective amount of dispersion will generally comprise above about 0.01 wt. % particulate material based on the dry weight of the reducible iron-containing material after contact with the particulate material. Preferably, the particulate material is in the range of about 0.01 wt. % to about 2 wt. %. A typical dispersion will contain from about 1 to 80% particulate material, the remainder being the dispersion medium, e.g. water. In the case bauxite is employed as a particulate material, a typical aqueous dispersion will be in the range of about 1% to about 80% solid material in water. Depending on contact conditions, the bauxite will be present on the reducible iron-containing material in the range of about 0.01 wt. % to about 1 wt. %. If bentonite is used as a particulate material, a typical aqueous dispersion will be in the range of about 1% to about 70%. Again depending on contact conditions, the bentonite will be present on the reducible iron-containing material containing in the range of about 0.1 wt. % to about 2 wt. %.

A typical kaolin dispersion will contain from about 1% to 80% solid material in the dispersion medium e.g. water. Again, depending on contact conditions, the amount of kaolin deposited on the reducible iron-containing material will be in the range of about 0.1 wt % to about 2 wt %.

When the dispersion of the present invention comprises particulate material(s) and fluxing agent(s), the "cluster abating effective amount" of dispersion will generally comprise particulate material in the range of from about 0.01% to 2% by weight based on the dry weight of the reducible iron-containing material after contact with the particulate material, and from about 0.01 to 15 wt % or still more preferred, 1 to 6 wt % fluxing agent based on the dry weight of the reducible iron-containing material after contact with the particulate material. The ratio of particulate material to fluxing agent in the dispersion will generally be in the range of from about 100:1 to 1:100. A preferred ratio of particulate material to fluxing agent is from about 1:10 to about 10:1; with a ratio of 1:5 to 5:1 being still more preferred. A typical dispersion will be a 1% to 80% dispersion with the ratio of particulate material to fluxing agent being in the range of 1:3 to 3:1.

The invention is further described by the following non-limiting examples.

EXAMPLES

Reducible iron-containing pellets were prepared from iron ore concentrate admixed with 0.2 wt. % bentonite, 1.5 wt. % dolomite and 0.06 wt. % Peridur 230 binder (a sodium carboxymethyl cellulose-containing binder available from Dreeland, Inc. of Denver, Colo., USA and Akzo Chemicals of Amersfoort, the Netherlands). Procedures for such iron ore pellet formation are well known to the skilled artisan, as, for example, demonstrated by European Patent Application EP 0 541 181 A1, EP 2 225 171 A2, U.S. Pat. No. 4,288,245, and the references cited therein. Accordingly, the detailed procedure need not be recited here. The formed green ball pellets were fired at about 1300° C.

Portions of the fired pellets were then separately contacted with dispersions of various particulate materials. For each particulate material dispersion tested in Examples 1, 2 and 3, a sample of 2 kg of the above described fired pellets was dipped in a 10% aqueous dispersion of the relevant particulate material for approximately 2 seconds, then dried at 105° C., leaving a deposit of about 0.05 wt. %. In Examples 5, 6 and 7, 9.09 wt % kaolin dispersions were employed while Example 4 employed a 16.67 wt % kaolin dispersion. Further, the dispersion of Example 7 was sprayed on the pellets as opposed to dipping the pellets. As indicated on Table I, bauxite, bentonite, Portland cement, and kaolin were tested as particulate materials. The average particle size of the bauxite and bentonite was 24 microns (d 80%<64 microns) and 13 microns (d 80%<21 microns) respectively, while the average particle size of the kaolin was 0.4 microns (d 88%<2 microns). Also, an additional sample of 2 kg of the above described fired pellets, identified as "Control", was subjected to no further treatment prior to direct reduction.

Each pellet sample was separately subjected to a reduction temperature of 850° C. (Examples 1–5) or 900° C. (Examples 6 and 7).

The reduced pellets were then subjected first to a "sticking tendency" test (to determine their tendency to cluster) and then to crushing strength test. The "sticking tendency" test was performed by dropping the reduced pellets from a height of one (1) meter. After each multiple of 5 drops (i.e., 5, 10, 15 and 20) the "clustered" pellets (a group of two or more pellets stuck together) and the "unclustered" pellets (single pellets) were weighed. The unclustered pellets were removed before the next series of 5 drops.

The crushing strength was determined using the procedure of ISO 4700, with the exception that ISO 4700 prescribes oxidized pellets and here reduced pellets were tested.

The results are reported in Table I.

TABLE 1

| Example | Control | (1) Portland Cement | (2) Bauxite | (3) Bentonite | Starting Material | (4) Kaolin (16.67 wt %) | (5) Kaolin (9.09 wt %) | (6) Kaolin (9.09 wt %) | (7) Kaolin (9.09 wt %) |
|---|---|---|---|---|---|---|---|---|---|
| | | | | Properties of Treated Iron Ore Pellets | | | | | |
| Chemical analysis | | | | | | | | | |
| Fe (total) | 67.43 | n.d. | 67.29 | 67.19 | 67.70 | 67.19 | 67.54 | 67.38 | 67.35 |
| FeO | 0.90 | n.d. | 0.90 | 0.83 | 0.40 | 0.48 | 0.28 | 0.22 | 0.31 |
| $SiO_2$ | 2.08 | n.d. | 1.99 | 2.42 | 2.04 | 2.29 | 2.10 | 2.18 | 2.12 |
| $AlO_3$ | 0.31 | n.d. | 0.35 | 0.43 | 0.38 | 0.58 | 0.44 | 0.45 | 0.46 |
| CaO | 0.57 | n.d. | 0.56 | 0.55 | n.d. | n.d. | n.d. | n.d. | n.d. |
| MgO | 0.37 | n.d. | 0.40 | 0.39 | n.d. | n.d. | n.d. | n.d. | n.d. |
| P | 0.012 | n.d. | 0.011 | 0.012 | n.d. | n.d. | n.d. | n.d. | n.d. |
| S | <0.01 | n.d. | n.d | n.d. | n.d. | n.d. | n.d. | n.d. | n.d. |
| $Na_2O$ | 0.029 | n.d. | n.d. | 0.056 | n.d. | n.d. | n.d. | n.d. | n.d. |
| $K_2$ | 0.015 | n.d. | n.d. | 0.023 | n.d. | n.d. | n.d. | n.d. | n.d. |
| Mn | 0.030 | n.d. | 0.04 | 0.020 | n.d. | n.d. | n.d. | n.d. | n.d. |
| $TiO_2$ | 0.080 | n.d. | 0.050 | 0.070 | n.d. | n.d. | n.d. | n.d. | n.d. |
| Reduction TEMP | 850° C. | 850° C. | 850° C. | 850° C. | 850° C. | 850° C. | 850° C. | 900° C. | 900° C. |
| Ave particle size particulate material | | | 24 microns | 13 microns | <2 microns | <2 microns | <2 microns | <2 microns | <2 microns |
| Clustering (%) of clustered pellets after | | | | | | | | | |
| -5 drops | 78.3 | 25.1 | 0 | 0 | | 0 | 0 | 38.8 | 56 |
| -10 drops | 45.1 | 2.8 | 0 | 0 | | 0 | 0 | 7.0 | 10.9 |
| -15 drops | 29.8 | 0 | 0 | 0 | | 0 | 0 | 1.5 | 1.8 |
| -20 drops | 20.5 | 0 | 0 | 0 | | 0 | 0 | 0 | 0.3 |
| Crushing strength after reduction | | | | | | | | | |
| -average (daN/P) | 36 | 58 | 41 | 51 | | 53 | 51 | 55 | 56 |
| -std. dev. (daN/P) | 16 | 19 | 15 | 20 | | 22 | 23 | 25 | 17 |
| -min. value (daN/P | 10 | 20 | 10 | 15 | | 20 | 25 | 21 | 24 |
| -max value (daN/P) | 90 | 100 | 70 | 100 | | 119 | 116 | 123 | 97 |
| Chemistry (%) | | | | | | | | | |
| -Fe (total) | 93.8 | 93.4 | 93.2 | 91.9 | | 93 | 94.1 | 93.2 | 93.2 |
| -Fe (metallic) | 90.0 | 88.4 | 87.8 | 89.5 | | 87.8 | 91.1 | 85.5 | 87.4 |
| -metallization | 96.0 | 94.7 | 94.2 | 97.4 | | 94.4 | 96.8 | 92.9 | 93.8 |

The foregoing examples have been presented to provide an enabling disclosure of the current invention and to illustrate the surprising and unexpected superiority in view of known technology. Such examples are not intended to unduly restrict the scope and spirit of the following claims.

I claim:

1. A method for lowering the incidence of clustering of reducible iron-containing materials during the direct reduction of the iron in said materials, said method comprising contacting said iron-containing materials prior to the direct reduction thereof with a cluster-abating effective amount of a dispersion which comprises at least one particulate material which is substantially nonhardening in the presence of water and at least one fluxing agent.

2. The method of claim 1 wherein said iron-containing materials are in the form of agglomerates, pellets, briquettes or granulates.

3. The method of claim 1 wherein said particulate material comprises aluminum.

4. The method of claim 3 wherein said particulate material comprises an aluminum-containing clay.

5. The method of claim 4 wherein said aluminum-containing clay is selected from the group consisting of bentonite, bauxite, kaolinite, attapulgite, dickite, nacrite, halloysite, pyrophyllete, montmorillonite, chlorite, hectorite, saponite, kaolin, sodium aluminum silicate and mixtures thereof.

6. The method of claim 1 wherein said fluxing agent comprises lime.

7. The method of claim 5 wherein said fluxing agent is selected from the group consisting of lime, hydrated lime, limestone, dolomite and mixtures thereof.

8. The method of claim 1 wherein said dispersion additionally comprises at least one additive selected from the group consisting of olivine, serpentine, magnesium, caustic, coke and mixtures thereof.

9. The method of claim 1 wherein the average particle size of said particulate material and said fluxing agent in the dispersion is between about 0.05 to 250 microns.

10. The method of claim 1 wherein said dispersion is a 1% to 80% dispersion which contains said at least one particulate material and said at least one fluxing agent in a ratio of from about 1:5 to 5:1.

11. The reducible iron-containing material produced by the method of claim 1.

12. The reducible iron-containing material of claim 11 wherein the amount of particulate material deposited by dispersion contact is between about 0.01 to 2 wt % of the iron one-containing materials.

13. The reducible iron-containing material of claim 11 wherein the amount of fluxing agent deposited by dispersion contact is between about 0.1 to 15 wt % of the iron ore-containing materials.

14. A method for lowering the incidence of clustering of reducible iron-containing materials during the direct reduction of the iron in said materials which comprises contacting said iron-containing materials prior to the direct reduction thereof with a cluster-abating effective amount of a dispersion which comprises at least one particulate material which is substantially nonhardening in the presence of water, wherein said particulate material has an average particle size of less than about 250 microns.

15. The method of claim 14 wherein said iron-containing materials are in the form of agglomerates, pellets, briquettes or granulates.

16. The method of claim 14 wherein said particulate material comprises aluminum.

17. The method of claim 16 wherein said particulate material comprises an aluminum-containing clay.

18. The method of claim 17 wherein said aluminum-containing clay is selected from the group consisting of bentonite, bauxite, kaolinite, attapulgite, dickite, nacrite, halloysite, pyrophyllete, montmorillonite, chlorite, hectorite, saponites, kaolin, sodium aluminum silicate and mixtures thereof.

19. The method of claim 17 wherein said particulate material has an average particle size of between about 0.05 to 200 microns.

20. The method of claim 14 wherein said particulate material is kaolin.

21. The reducible iron-containing material produced by the method of claim 14.

22. The reducible iron-containing material of claim 21 wherein the particulate material deposited by dispersion contact is about 0.01 to about 2 wt. % of the iron ore-containing material.

23. A method for lowering the incidence of clustering of reducible iron-containing materials during the direct reduction of the iron in said materials, said method comprising contacting said iron-containing materials prior to the direct reduction thereof with a cluster-abating effective amount of a dispersion which comprises at least one aluminum-containing clay selected from the group consisting of kaolinite, attapulgite, dickite, nacrite, halloysite, pyrophyllete, montmorillonite, chlorite, hectorite, saponite, kaolin, sodium aluminum silicate and mixtures thereof.

24. The method of claim 23 wherein said iron-containing materials are in the form of agglomerates, pellets, briquettes or granulates.

25. The reducible iron-containing material produced by the method of claim 24.

* * * * *